US005123119A

United States Patent [19]

Dube

[11] Patent Number: 5,123,119

[45] Date of Patent: Jun. 23, 1992

[54] BREATHABLE GLOVE

[75] Inventor: Roland E. Dube, Topsfield, Mass.

[73] Assignee: Worthen Industries, Inc., Nashua, N.H.

[21] Appl. No.: 368,022

[22] Filed: Jun. 19, 1989

[51] Int. Cl.[5] ..... A41D 19/00

[52] U.S. Cl. ..... 2/168; 2/169

[58] Field of Search ..... 2/169, 164, 167

[56] References Cited

U.S. PATENT DOCUMENTS

| | | | |
|---|---|---|---|
| 2,004,382 | 2/1935 | Palicki | 2/164 |
| 2,650,365 | 9/1953 | Singer | 2/167 |
| 3,866,245 | 2/1975 | Sutherland | 2/167 |
| 3,916,448 | 11/1975 | Hamel | 2/167 |
| 4,065,826 | 1/1978 | Hough | 2/167 |
| 4,194,041 | 3/1980 | Gore et al. | 2/167 |
| 4,359,783 | 11/1982 | Andrews | 2/167 |
| 4,430,759 | 2/1984 | Jackrel | 2/167 |
| 4,476,588 | 10/1984 | Long | 2/167 |
| 4,545,841 | 10/1985 | Jackrel | 2/167 |
| 4,569,088 | 2/1986 | Frankenburg et al. | 2/167 |
| 4,583,248 | 4/1986 | Edwards et al. | 2/167 |
| 4,662,006 | 5/1987 | Ross, Jr. | 2/167 |
| 4,741,052 | 3/1988 | Rubin | 2/167 |

*Primary Examiner*—Paul T. Sewell
*Assistant Examiner*—Ted Kavanaugh
*Attorney, Agent, or Firm*—Samuels, Gauthier & Stevens

[57] ABSTRACT

This invention embodies a two component, waterproof, breathable glove and the corresponding method of forming the glove. A homogeneous membrane in regard to its permeability characteristics is attached to a fabric. The membrane is tacky on one surface and wear resistant on the other surface. Using a contoured mold and foam forms the layers for the inner liner are cut and are thermowelded or bonded together to form a three dimensional inner shell of a glove. Then the formed inner shell is attached to an outer glove shell by conventional methods.

15 Claims, 1 Drawing Sheet

BREATHABLE GLOVE

BACKGROUND OF THE INVENTION

Waterproof gloves including "breathable" waterproof gloves have been marketed for several years, and can be found in gloves manufactured for outdoor sports such as hunting, skiing, snowmobiling, and also for the comfort and protection of firefighters, policemen, uniformed personnel and those other persons who have outdoor employment.

These gloves, particularly the breathable styles, have been costly and difficult to manufacture. Usually, they consist of three principal components (a) a breathable, stretchable, waterproof barrier film suitably supported on a carrier web, (b) a textile fleece inner liner and (c) an outershell.

The prior art discloses the three component glove, see U.S. Pat. No. 4,679,257 and the references cited therein. The individual parts consist of an outer shell of glove shape configuration, usually of leather; an inner liner, generally fashioned from an insulator such as a fleece-like napped textile for skin comfort; and a membrane barrier fashioned into glove configuration from a breathable coated fabric or unsupported membrane and this is positioned between the inner liner and outer shell.

Each of the three components are fabricated to proper pattern size, then assembled into a three component glove or mitten by means of a stitching or adhesive bonding in place.

The number of steps, and the precision stitching necessary to properly assemble the item makes it very labor intensive and expensive. Generally, the stitching, or adhesive bonding, provides sufficient internal cohesiveness between parts to resist the withdrawal forces applied by the removal of the hand from the glove without allowing any disengaging of the component parts.

SUMMARY OF THE INVENTION

Broadly, the present invention embodies a two component glove, which may be a waterproof or breathable waterproof glove, and the method of forming the glove.

A membrane, either a waterproof or a breathable waterproof membrane, is coated on the backside (non-fleece) of an inner liner fabric. This coated inner liner fabric is cut into patterns to form upper and lower panels. These panels are joined to form the inner liner through thermowelding or bonding of the outside edges of the coated surfaces to provide a waterproof seam. The welded seam includes extensions bonded by the welded seam to allow for easy attachment to an outer glove shell by conventional stitching methods eliminating the need to resort to the use of adhesives to combat hand withdrawal forces.

In the present invention, the inner liner is formed through the use of a contoured forming mold to provide a three dimensional glove which allows easy access to the hand and comformability when worn. The three dimensional feature allows movement of the dead air interspaced between portions of the skin and the liner. This, in turn, through normal movement of the hand within the glove creates a bellows action which, for the breathable membrane, additionally promotes body water diffusion and accelerates its exit through the barrier membrane. By use of the method of the invention, the manufacturing time necessary to complete a suitable glove is drastically reduced over prior art gloves and the resulting manufacturing costs are dramatically lowered.

In a preferred embodiment of the invention, a breathable urethane skin is cast on release paper. A compatible breathable adhesive layer is cast on the urethane skin. The non-fleece side of a liner fabric is joined to the adhesive layer. This is processed to combine the skin and adhesive layer to form a homogeneous breathable membrane Subsequently, the release paper is removed and the glove patterns formed and molded to form the liner.

BRIEF DESCRIPTION OF THE DRAWINGS

FIG. 3 is a sectional view of the assembled glove;

DESCRIPTION OF THE PREFERRED EMBODIMENT

Figure 1:
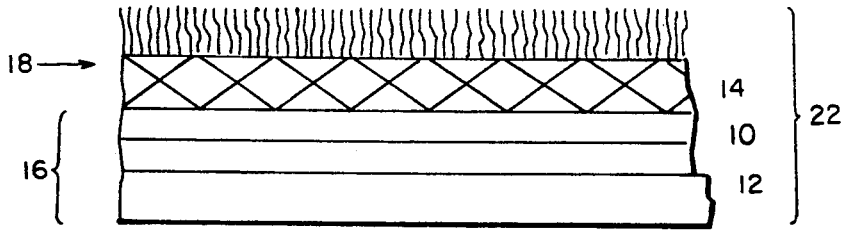
FIG. 1 is a sectional view of an inner liner of the invention.

The preferred embodiment will be described in reference to a breathable membrane. In the preparation of an inner liner, referring to FIG. 1, a polymerized aliphatic polyurethane resin 10 is coated on a substrate 12 using a conventional knife-over-roll textile/paper coating machine. The substrate being coated with the polyurethane is a conventional silicone coated Kraft release paper of 70 pound wt. like H. P. Smith's S/8002 release sheet, or Mead Paper Company's Arco-Schuellar 65 ISE 60-F sheet. The polyurethane skin or coating 10, such as Upaco TEC-1264 available from Upaco Adhesives, Nashua, N.H., is applied to the release side of the release paper 12 in a thickness, that when the coating applied at approximately 37% total solids content is dried in a conventional hot air convection oven to evaporate the fluid portion of the coating, the dried, elastic-like film will be approximately 1 oz/sq. yard in weight and measure between 0.00075 and 0.001 inch gauge.

The coated paper is brought to a second coating application station comprised of a knife-over-roll adhesive applicator, wherein an adhesive coat 14 is applied over the first skin to form a lamina 16. The coating is applied at between 0.008 to 0.009 inch gauge and an amount of 1 to 1.5 oz/sq. yard as applied. Suitable adhesives are available from Upaco Adhesives, Nashua, N.H., TEC-1264A and Raffi & Swanson, Wilmington, Mass., No. 10055.

The still-wet adhesive coat is "married" by combining to the non-fleece side of the intended glove liner fabric 18, or any suitable fabric, including knitted jersey tricot material to form a web 22. Textile fabrics suitable for attachment to the breathable membrane system are Kevlar/Nomex Blend CO42 made and sold by W. L. Libbey Co., Lewiston, Me.; Modacrylic fleece fabric 3017 made and sold by W. L. Libbey Co., Lewiston, Me., and Buckley & Mann Co., Franklin, Mass.; Thinsulate, made and sold by 3M Company, St. Paul, Minn.; Delsolite, made and sold by Nylco Corporation, Nashua, N.H.; or Urethane foam, General Foam Co., Paramus, N.J. The amount of adhesives used will vary depending upon the fabric to which it is combined.

The moving web 22, now comprising the carrier release paper, first and second coats and liner fabric enters a hot air convection textile dryer oven to provide evaporation of the adhesive fluid component and subsequent cross-linking ("curing") of the skin and adhesive into a breathable membrane with resistance to water. The coated/laminated substrate, still on the carrier release paper passes through a drying chamber, first through a temperature zone of 200°-215° F. to gently evaporate residual adhesive fluid without causing bubbles in the film, and then for one minute in a temperature zone of 300° F. to effect a chemical reaction, thermosetting and crosslinking of the urethane skin and adhesive, forming a breathable membrane 20 (see FIG. 3) and insuring the permanent bonding of the membrane to the textile glove liner. Although the membrane is homogeneous concerning its breathability properties, its physical properties vary. At the interface or bonding surface between the membrane and the fabric the membrane, although dry, is tacky. As the membrane distance increases from the fabric, the membrane becomes less tacky and more firm to provide maximum wear resistance for the membrane.

The membrane, when dried and positioned in the glove, must not only possess good bonding strength to the textile liner, it must also itself have the 'breathability' capability of allowing moisture vapor transmission at a minimum level of 500 grams per sq. meter per 24 hours when tested according to ASTM E96 Dessicant Method. This is the minimum water vapor escapement believed to be necessary to allow elimination of body moisture from the glove to avoid discomfort.

It is also important that while water vapor transmission is a necessary characteristic of the adhesive, it must be capable, like the skin, of resisting the penetration of fluid water into the inner textile liner of the glove.

Upon emerging from the oven, the webs are led through a device wherein the release paper is stripped from the membrane/textile composite, and rerolled for future reuse. The stripped glove liner material is simultaneously rolled for further use in glove manufacture.

Figure 2:
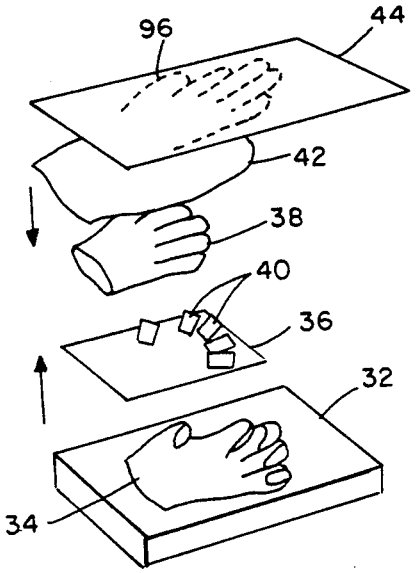
FIG. 2 is a perspective view of the assembly mold.

The inner liner is formed into a glove by cutting two generally square pieces of sufficient size from the membrane coated lining fabric. Referring to FIG. 2, a contoured mold 32 recessed in the form of a hand includes a sealing lip 34 formed on its upper surface. A piece of lining fabric 36 is placed on the die. A sponge form 38 in the shape of a hand is placed on the panel 36. Inserts 40, usually thin strips of fabric coated on both sides with membrane 20, are placed on the liner 36 where the tips of the fingers and thumb will be formed. The inserts 40 overlie the areas where the seam will be formed and extend inwardly beyond the areas where the seam will be formed. A second liner 42 is placed over the form 38. The liner membranes are face-to-face. A platen 44 closes with the mold 32 and seals the liners 36-42 on all sides but one, the wrist position. In the dielectric heat welding operation the outside seams of the glove liner configuration are heat sealed for waterproof containment. The inserts 40 having the same membrane material as the liner are formed integrally with the liner—to form waterproof seals. The coating on the inserts need not be identical to the membrane material as long as the inserts adhere to the membrane and form a waterproof bond. The surplus material is then trimmed to the proper glove configuration.

Figure 4:
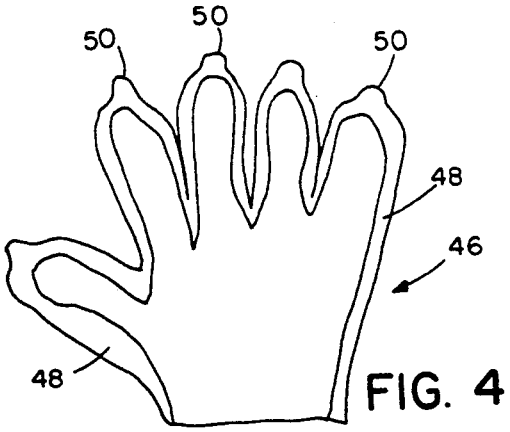
FIG. 4 is a plan view of the lines.
Figure 5:
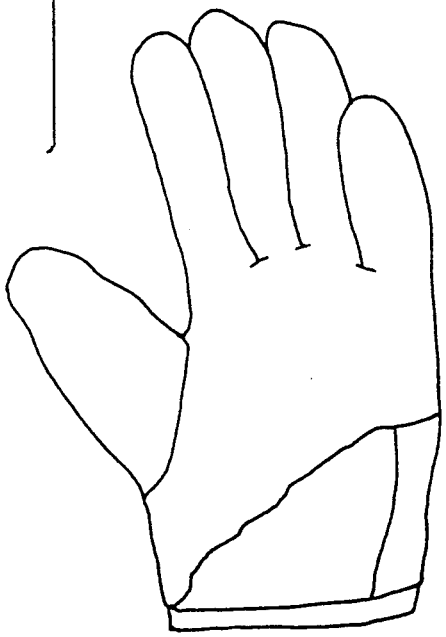
FIG. 5 is a perspective view of a glove of the invention.
Figure 5:
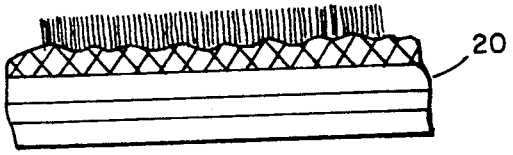

The liner is then turned inside out as shown in FIG. 4, and the inserts, which are simply extensions of the liner material, now extend outwardly.

The basic assembly of the finished glove requires only conventional glove making procedures.

a) A pattern is cut for the outside shell, usually of leather, but not limited thereto.

b) The inner liner is then attached to the outer liner by conventional stitching operations, care being taken not to puncture the membrane section. The stitch line is along the outside edge of the inserts. The liner is generally attached to the outside shell at the ends of the finger and thumb positions.

c) The inner lining is secured by the wrist of the glove by conventional stitching to the outside layer.

In an alternative embodiment of the invention, the membrane may be simply waterproof and not breathable. The process conditions for forming the waterproof membrane are substantially the same as for the breathable membrane. Suitable materials for skins, specifically urethanes, include Clear Durane Coating 9648, Raffi & Swanson, Wilimington, Mass.; Clear Milloxane Coating TC 201, Polyurethane Specialties Co., Lyndhurst, N.J. For the adhesive coating, specifically urethane, Clear Milloxane BC 300HA, Polyurethane Specialties and Clear Sancore 9500B, Sancore Industries, Inc., Leominster, Mass.

Although described in reference to urethane membranes, other breathable and/or waterproof membranes may be used such as vinyl membranes, polytetraflouro ethylene membranes, i.e. Goretex ®, etcetera.

In this disclosure there is shown and described preferred embodiments of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it, each as may be best suited in the condition of a particular case.

Having described my invention, what I now claim is:

1. A glove liner which comprises:

a breathable fabric;

a homogeneous membrane bonded to the fabric to form a coated lining fabric, the membrane characterized by an inner tacky surface adhered to the fabric and an outer wear-resistant surface, the membrane being progressively less tacky as the membrane distance from the fabric increases;

the membrane surfaces joined together along a seam to define the liner, the liner being closed on all sides except one through which a hand may extend into the liner, the fabric comprising the inner surface of the liner, the membrane comprising the outer surface, the periphery of the liner where closed having at least one pattern extension whereby the liner may be secured to an outer shell by joining the pattern extension to the outer shell.

2. The liner of claim 1 wherein the seam formed is waterproof.

3. The liner of claim 1 wherein the outer shell is joined to the inner liner to form a glove, the outer shell closed along its sides except at one end which end is open to allow for the passage of a hand therein and which shell open end is secured to the open end of the liner to form a glove.

4. The liner of claim 1 wherein the membrane is a breathable membrane.

5. The liner of claim 1 wherein the membrane is a waterproof membrane.

6. The liner of claims 4 or 5 wherein the membrane is a urethane membrane.

7. The liner of claim 1 wherein inserts have been placed in the tips of the fingers and thumbs.

8. A method of forming a glove liner which comprises:

forming a skin of polymeric material on a release surface;

casting polymeric adhesive on said skin;

bonding the adhesive to a fabric; and reacting the skin and adhesive to form a homogeneous membrane, the surface of the membrane bonded to the fabric being tacky, the membrane becoming less tacky as its distance from the fabric increases.

9. The method of claim 8 which includes:

forming a three dimensional inner liner by joining panels of the liner with the membrane sides face-to-face.

10. The method of claim 8 which includes sealing the liner along its edges except for one end which remains open to allow for passage of a hand therethrough.

11. The method of claim 8 which includes joining the inner liner to an outer shell to form a glove.

12. The method of claim 8 wherein the membrane is a breathable membrane.

13. The method of claim 8 wherein the membrane is a waterproof membrane.

14. The method of claims 12 or 13 wherein inserts have been placed in the tips of the fingers and thumbs.

15. The method of claim 12 wherein the membrane is a urethane membrane.

* * * * *